United States Patent [19]

McCrone et al.

[11] Patent Number: 4,484,742

[45] Date of Patent: Nov. 27, 1984

[54] STRINGING TOOL FOR TENNIS RACKETS AND THE LIKE

[76] Inventors: James G. McCrone, 1654 Empire, Lincoln Park, Mich. 48146; Warren R. Heiser, 934 N. Mildred, Dearborn, Mich. 48128

[21] Appl. No.: 443,396

[22] Filed: Nov. 22, 1982

[51] Int. Cl.[3] ..... A63B 51/14

[52] U.S. Cl. ..... 273/73 A

[58] Field of Search ..... 273/73 A, 73 B; 254/133 R, 29 A; 83/175

[56] References Cited

U.S. PATENT DOCUMENTS 1,120,798 12/1914 Duecker ..... 273/73 A 3,441,275 4/1969 Held ..... 273/73 A

FOREIGN PATENT DOCUMENTS 620852 12/1980 Fed. Rep. of Germany ..... 83/175

*Primary Examiner*—Richard C. Pinkham

*Assistant Examiner*—Matthew L. Schneider

*Attorney, Agent, or Firm*—Hauke and Patalidis

[57] ABSTRACT

A stringing tool for a racket, such as a tennis racket for example, provided with individual strings for the net-like interlacing stringing covering the open area of the racket frame, each individual string being anchored at both ends, for example, by a collapsible anchoring clip disposed in a stringing aperture through the racket frame. The stringing tool comprises a pair of jaws for grasping the end of the string projecting beyond the racket frame, the jaws being mounted on a slide coupled to a second slide movable by lever action. The coupling between the two slides has an adjustable releasable mechanism operable to disconnect one slide from the other upon exerting a pull of a pre-determined force on the string. The stringing tool is preferably further provided with a clipper for cutting off the portion of the string projecting from the side of the racket frame after the string has been stretched taut from one side of the frame to the other and securely anchored by the clips in the frame stringing holes.

27 Claims, 16 Drawing Figures

STRINGING TOOL FOR TENNIS RACKETS AND THE LIKE

CROSS-REFERENCE TO RELATED APPLICATION

The present application is a continuation-in-part of application Ser. No. 297,851, for Improved Tennis Rackets and the Like and Method of Stringing Tennis Rackets and The Like, filed Aug. 31, 1981 now abandoned.

BACKGROUND OF THE INVENTION

The present invention relates to a stringing tool for rackets such as the rackets used for playing tennis, squash, badminton and like games.

Tennis rackets, and the like, as is well known, are structurally made of a generally oval frame, made of laminated wood, metal, or composite materials such as glass or carbon fibers provided with an integral handle or grip. The open area within the frame is covered with a plurality of interlacing "horizontal" and "vertical" criss-crossing strings, regularly spaced and running from one side of the frame to the opposite side and from the bottom of the frame, provided with the handle, to the top of the frame. The strings generally consist of a single length, or of two lengths of a string made of, for example, sheep gut, or nylon. Each length of string is laced through appropriate apertures, or stringing holes, through the periphery of the frame between the open area of the frame and the peripheral surface of the frame. During the manufacture of the racket, or when the racket is restrung, one end of the string is provided with a knot which forms an anchoring means for the end of the string in the frame start stringing hole, and after the full length of string has been laced through the stringing holes to form a net-like arrangement disposed within the frame, tension is applied by way of an appropriate tensioning device for tensioning the whole length of string, and consequently each individual string with an appropriate tensioning force, for example 55 to 60 lbs. for tennis racket, 35 to 45 lbs. for squash rackets, and 25 to 30 lbs. for badminton rackets. The free end of each length of string is then appropriately tied.

Such a structure, and the method for stringing rackets, present many inconveniences. When using one or two lengths of string, each length of string must be laced alternatively above and below each of the already installed string portions, and laced in a regular pattern through the stringing holes in the frame, doubled back and laced through an adjacent stringing hole in the frame, and returned to the other side of the frame, once again passing over and under the already installed perpendicular string portions. If one of the individual string portions breaks during use, the whole racket has to be restrung, when a single length of string is used, as no means are provided for anchoring each individual string section in the stringing holes.

In addition, stringing machines are complex and costly, and restringing requires that stringing machines be used in order to do the job efficiently. Some of the disadvantages and shortcomings of the prior art racket stringing arrangements and methods have been remedied by providing individual string lengths and frame anchoring means for each horizontal and vertical string of a racket, as disclosed for example in U.S. Pat. Nos. 3,994,495, 4,140,316, 4,309,033, British Pat. Specification No. 2,071,253 and co-pending application Ser. No. 297,851, for example.

SUMMARY OF THE INVENTION

The principal object of the present invention is to provide a stringing tool for improved rackets whose horizontal and vertical strings are individually strung, tensioned and anchored at the frame of the racket. The present invention provides a stringing tool which greatly simplifies the manufacture of a racket, which requires no particular skill on the part of workers manufacturing rackets, and which permits the owner of a racket to restring his or her racket at low cost, without the use of complex and expensive restringing apparatus. Furthermore, the present invention permits to replace ruptured or damaged individual strings without having to restring the whole racket, after a racket has been originally strung or restrung with short lengths of strings.

Other objects and advantages of the present invention will become apparent to those skilled in the art when the following description of the best mode contemplated for practicing the invention is read in conjunction with the accompanying drawings wherein:

DETAILED DESCRIPTION OF THE PREFERRED EMBODIMENT

Figures 1, 2, 2A, 3:
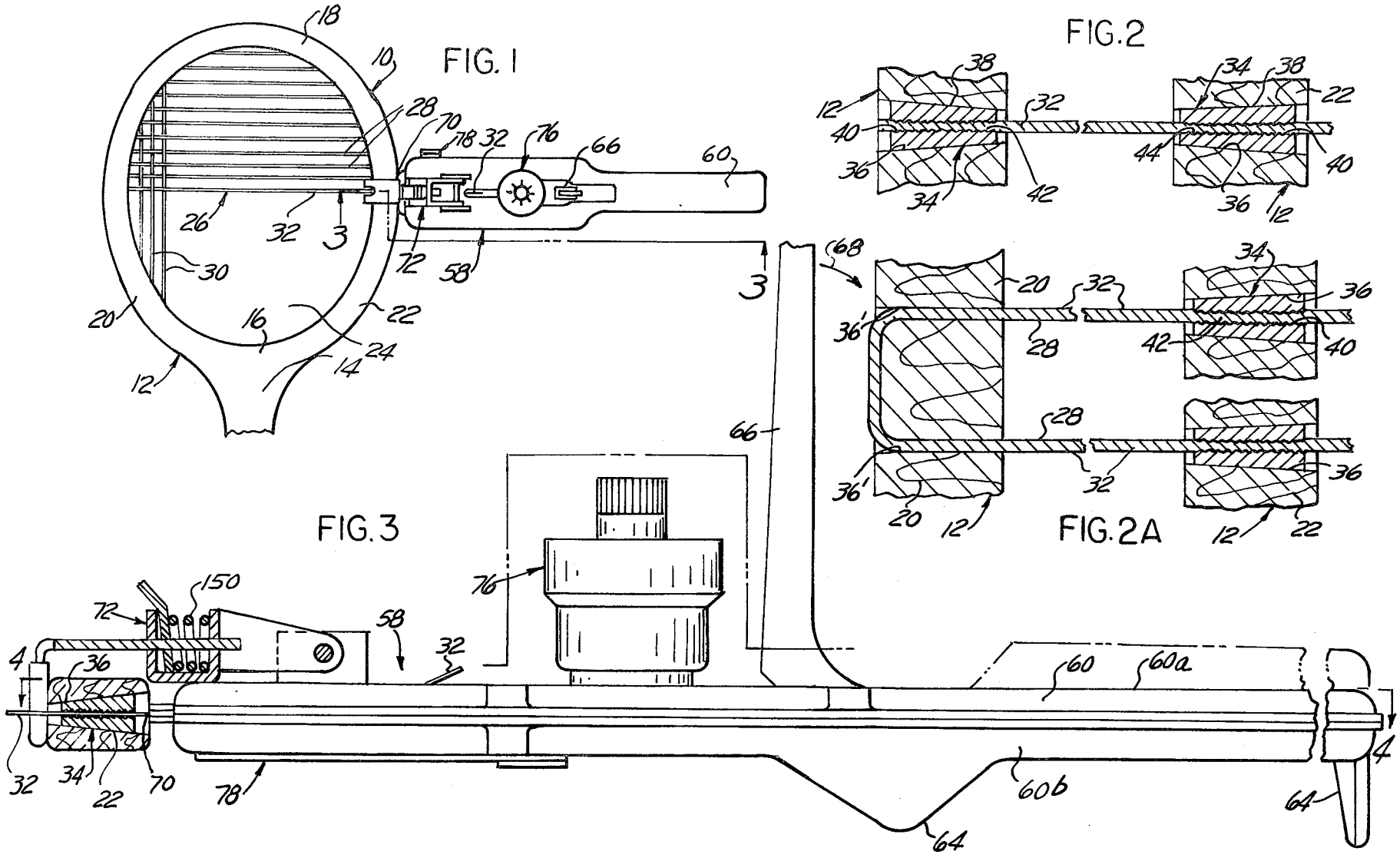
FIG. 1 is a schematic illustration of a tennis racket, for example, in the process of being strung or re-strung by the stringing tool of the present invention.
FIG. 2 is a section through opposite sides of the frame of a racket strung according to the present invention.
FIG. 2*a* is a section similar to FIG. 2 but showing a modification thereof.
FIG. 3 is a side elevation view of the racket stringing tool of the present invention as seen from line 3—3 of FIG. 1, showing the racket clamp partly in section.

Referring now to the drawings, and more particularly to FIGS. 1 and 2, a racket 10 is illustrated, consisting of a generally oval frame 12, made of laminated wood for example, which is provided on a narrow side with a centrally disposed integral handle or grip 14. For the sake of orientation, the end of the frame 12 provided with a handle or grip 14 is considered to be the shoulder or bottom 16 of the frame, the side opposite to the bottom 16 is considered to be the top 18 of the frame and the two opposite lateral sides of the frame are considered to be respectively the left side 20 and the right side 22 of the frame. As is conventional in tennis rackets and the like, the open area 24 within the frame 12 is provided with a net-like string pattern 26 forming rows of regularly spaced "horizontal" strings 28 stretched between the left side 20 and the right side 22 of the frame 12, interlaced with a plurality of "vertical" strings 30, regularly spaced and stretched perpendicular to the horizontal strings 28 between the bottom 16 and the top 18 of the frame 12.

In conventional racket netting structure, the horizontal strings 28 and the vertical strings 30 are actually made of a single length, or of two lengths, of string such as sheep gut or nylon, for example, provided with an anchoring knot at one end to prevent pulling through a start stringing hole in the frame 12, generally at a top corner, or at a bottom corner of the frame. The free end of each single length of string is passed and laced through transverse apertures, or stringing holes, through the frame.

According to the present invention, each horizontal string 28 and each vertical string 30 consists of a single length of string 32, FIG. 2, which is anchored at one end by an anchoring clip 34 disposed in a tapered stringing hole 36 through the frame 12, for example in the left side 20 of the frame. The individual string 32 is anchored at its other end by way of an anchoring clip 34 disposed in a corresponding tapered stringing hole 36 in the right side 22 of the frame 12. Alternatively, FIG. 2*a*, a single length of string 32 may be used to form two consecutive parallel horizontal strings 28, or vertical strings 30, not shown at FIG. 2*a*, by being anchored at one end by an achoring clip 34 in a tapered stringing hole 36, laced through two consecutive stringing holes 36' of conventional shape on opposite sides 20 of the frame 12 and anchored at its other end by an anchoring clip 34 disposed in a tapered stringing hole 36.

The tapered stringing holes 36 for each string 32 are aligned and they may conveniently consist of the conventional stringing holes through the frame 12 of a conventional racket, which are provided with enlarged bores having opposite tapers, such that the wall of the bores converge towards the inside area 24 of the frame 12. As best shown in detail at FIGS. 2–2*a* each anchoring clip 34 has a frusto-conical peripheral surface 38 conforming to the receiving tapered bore of the stringing hole 36. The clip 34 has a longitudinal cylindrical bore 40 provided with a plurality of regularly disposed annular serrations 42 in the form of annular grooves presenting at their intersecting surfaces a sharp annular edge 44.

The anchoring clips 34 may, for example, have the structure disclosed in co-pending application Ser. No. 297,851, filed Aug. 31, 1981. The anchoring clips 34, FIGS. 2–2*a* may be made of a single-piece metal stamping formed and bent such as to provide a plurality of segments or they may be made of molded metal or plastic having interconnected or separate segments.

Whatever the structure adapted for the anchoring clips 34, they are allowed to collapse when inserted in the tapered bore of a stringing hole 36. The central bore 40 of the anchoring clips 34 which, for all practical purpose, has a diameter corresponding to the diameter of the sharp edges 44 of the grooves normally accepts freely a string 32 with the sharp edges 44 slidably engaging the surface of the string. However, when the clip 34 is collapsed, FIGS. 2–2A, the peripheral surface of the string 32 is securely gripped by the sharp edges 44, thus providing a convenient and sturdy anchoring means for each end of each individual string 32.

In order to initially string a racket 10, FIG. 1, or, in order to restring a racket 10, individual strings 32 are provided at an appropriate length which is slightly more than the length required for extending from one side 20 to the other 22 or from the bottom 16 to the top 18 of the racket. One end of the string 32 is placed through the bore 40 of an anchoring clip 34, FIGS. 2 and 2*a*, which is inserted in the tapered bore of a stringing hole 36 in an appropriate direction to cause the anchoring clip 34 to collapse and grip the string 32. The other end of the string 32 is passed through the bore 40 of the corresponding opposite anchoring clip 34 disposed in the appropriate stringing hole 36 and the stringing tool 58 of the invention is used for tensioning the string 32 to an appropriate tension, 55 lbs. for example. The stringing tool 58 is adapted to grip the free end of the string 32, as is hereinafter explained in detail, and by motion of a movable lever to apply a preset tension or pull on the end of the string 32, and to cut the end of the string projecting from the string hole. The string 32 is appropriately tensioned by means of the stringing tool 58 and when the stringing tool 58 relieves the tension on the string 32, the second end of the string 32 tends to be pulled towards the other already attached end, thus causing the clip 34 to partially collapse due to the engagement of the internal sharp edges 44 of the grooves 42 with the peripheral surface of the string 32 and due to the conforming taper of the peripheral surface 38 of the clip and of the tapered bore of the stringing hole 36, such that both ends of the string 32 are solidly anchored to the frame 12 in the stringing holes 36.

Figure 4:
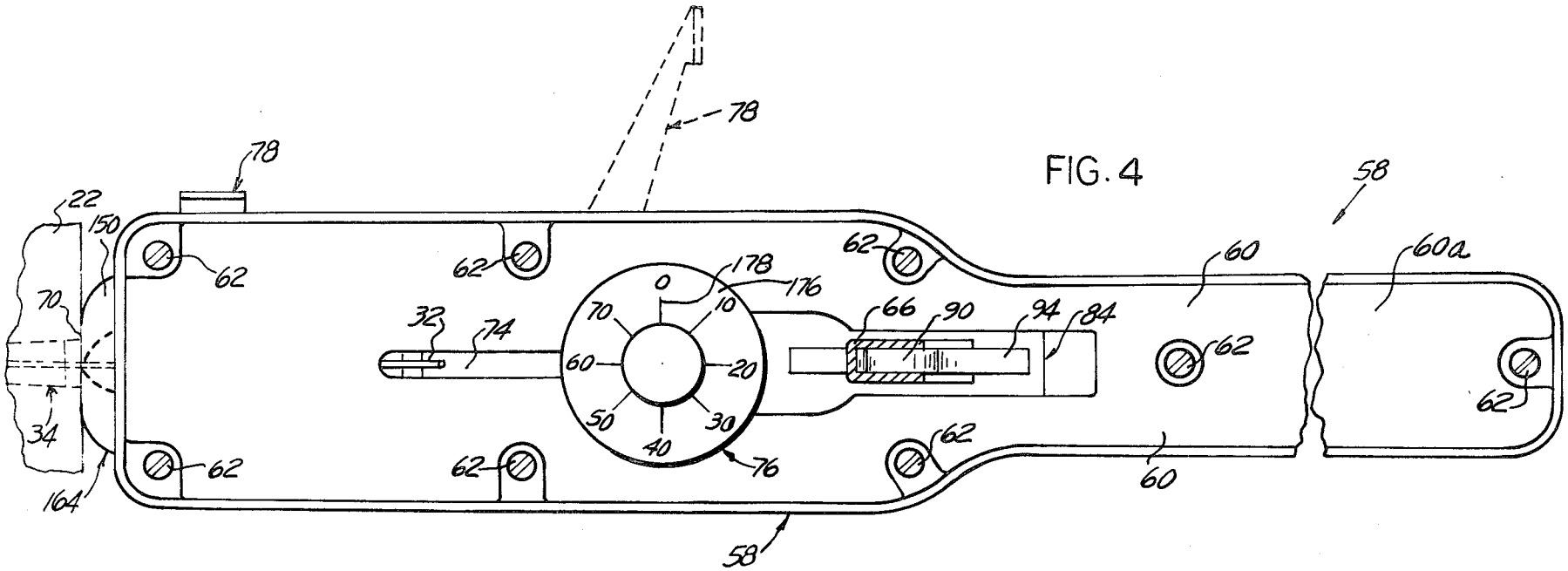
FIG. 4 is a top plan view thereof, with the racket clamp omitted.

The stringing tool 58, FIGS. 1 and 3–4, has a housing 60, made of any convenient material such as light metal or, preferably, plastic. The housing 60 is made of two sections, an upper portion 60*a* and a lower portion 60*b*, attached together by convenient fastener means such as screws 62. The lower portion 60*b* of the housing 60 has a pair of downwardly projecting portions 64 for engagement with a support surface such as a table top for example, and a lever 66 is pivotably disposed projecting from the upper portion 60*a* of the housing 60. The lever 66 is manually actuatable from a position illustrated in full line at FIG. 3, substantially perpendicular to the housing 60, in the direction of the arrow 68, in the course of a stringing operation. With the lever 66 in the vertical position, and a side, for example the right side 22 of the racket frame 12, held against the forward tip 70 of the tool 58 either manually or by way of an adjustable clamp 72 fastened on the top of the housing 60 at its forward end, the length of string 32 extending from the left side 20 of the racket frame 12 is threaded through the appropriate stringing hole 36 in the right side 22 of the racket frame and through the clip 34 loosely inserted in the stringing hole 36. The end of the string 32 is introduced into an aperture in the forward end or tip 70 of the stringing tool 58 until it projects through an opening 74 on the top of the housing 60. The appropriate amount of desired tension is set by means of an adjusting knob 76. The lever 66 is swung in the direction of the arrow 68 to apply tension on the string 32 and, automatically as will be described hereinafter in further detail, when the pre-set amount of tension or pull is exerted on the string 32 the string is released by the gripping means within the stringing tool 58 and tends to retract, with the result that the tips 44 of the serrations 42 in the anchoring clip 34 are caused to firmly engage the periphery of the end of the string 32 passed through the clip thus holding it firmly in position with the appropriate tension as pre-set. Subsequently thereto, a clipper operating lever 78 is actuated from the position shown in full lines at FIG. 4 to the position shown in phantom lines for automatically clipping the end portion of the string 32 projecting from the frame side 22 substantially flush with the outer end of the stringing hole 36.

As shown in detail at FIGS. 5–6, 8 and 10 the stringing tool 58 has a frame 80 mounted within the housing 60 and supporting a slide 82, a spacer plate 83 being disposed between the frame 80 and the slide 82 on the top of which is disposed a second slide 84. The operating lever 66 is pivotably attached at one end to a bracket 86, affixed below the frame 80, by way of a pivot pin 88. The end portion of the lever 66 attached to the bracket 86 by means of the pivot pin 88, and the bracket 86 itself are covered by the downwardly projecting portion 64, FIG. 3, of the housing 60.

The actuating lever 66 is provided with a roller 90 disposed in an aperture 92 formed in a plate 94 fastened on the top of the upper slide 84, such that pivoting motion of the lever 66 causes the slide 84 to reciprocate relative to the frame 80. The slide 84 has an opening 96 in which is fastened the lower end of a cylinder 98. The cylinder 98 is provided at its upper end with a peripheral thread 100 threadably accepting a sleeve 102 having an internally threaded bore 104 engaged with the peripheral thread 100 of the cylinder 98. The sleeve 102 has a reduced diameter threaded bore portion 106 in which is threadably fitted a plug 108 having a peripherally threaded portion 110 engaged with the sleeve threaded bore portion 106. A coil spring 112 is disposed in the cylinder 98 between the end of the plug 108 and a disk 114 disposed above and in engagement with, for example, three steel balls 116 placed each in a bore 118 formed in the bottom of the cylinder 98. Each steel ball 116 projects through the bore 18 into an aperture 120 in the slide 82 of a diameter smaller than the diameter of the ball 116. It is readily apparent that the pressure exerted upon the balls 116 by the coil spring 112, through the intermediary of the disk 114, is a function of the amount of penetration of the plug 108 within the bore of the cylinder 98. When the lever 66 is swung in the direction of the arrow 68, the slide 84 is displaced toward the right of the drawing, and the slide 82 coupled to the slide 84 through the balls 116 projecting into the apertures 120 in the slide 82 is also displaced in unison with the slide 84 towards the right, as seen in the drawing.

Figure 5:
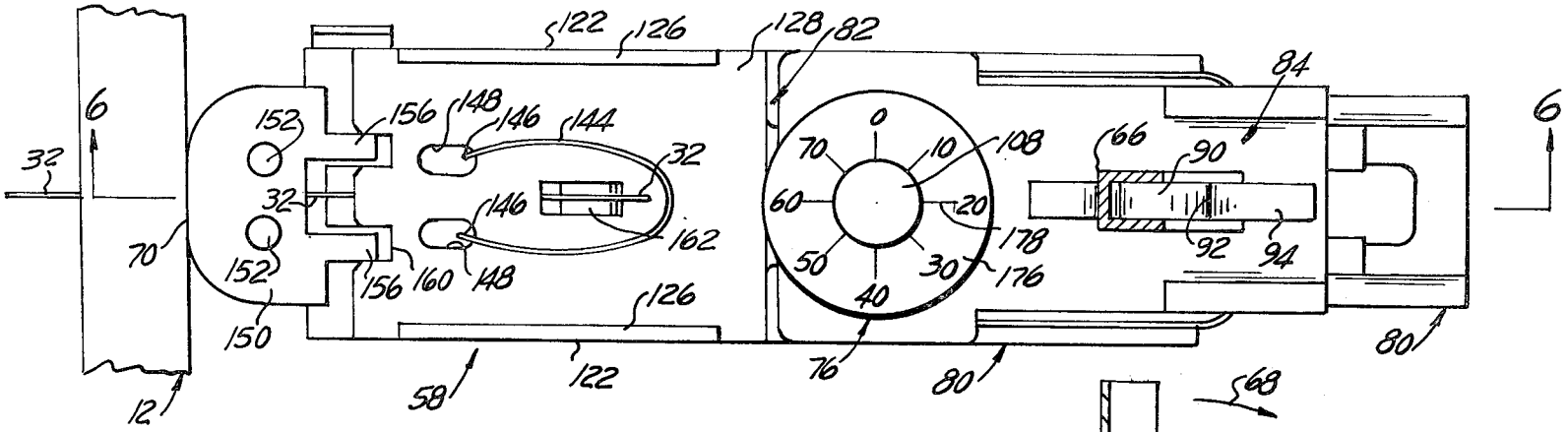
FIG. 5 is a top plan view thereof with the housing removed to show the internal construction.
Figure 7:
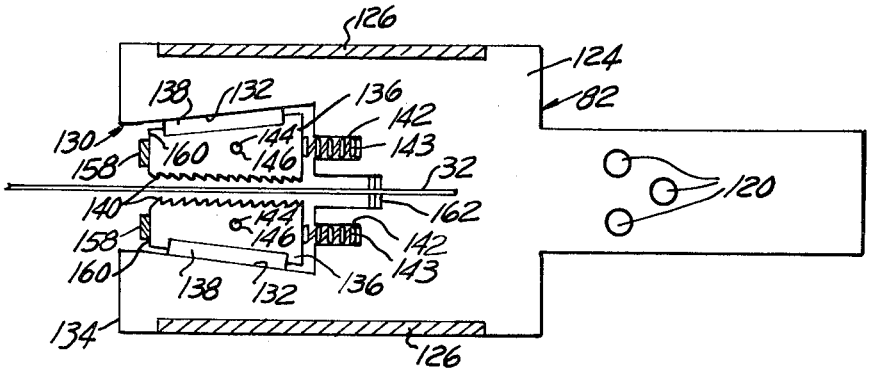
FIG. 7 is a partial view generally from line 7—7 of FIG. 6.

The frame 80 has a pair of forwardly disposed parallel side walls 122, FIG. 5, disposed each on one side and forming a guide surface for each of the lateral edges of a forward enlarged portion 124, FIG. 7, of the slide 82. Each side wall 122 terminates into a bent-over flange portion 126, FIG. 5, retaining in position a plate 128 disposed over the slide 82 at its enlarged portion 124. The enlarged portion 124 of the slide 82 is therefore slidably disposed in a channel formed by the upper surface of the frame 80, the lateral walls 122 and the cover plate 128. The channel is higher than the thickness of the enlarged portion 124 of the slide 82 to provide room for a string clipper 164 disposed between the upper surface of the frame 80 and the lower surface of the enlarged portion 124 of the slide 82.

Figure 6:
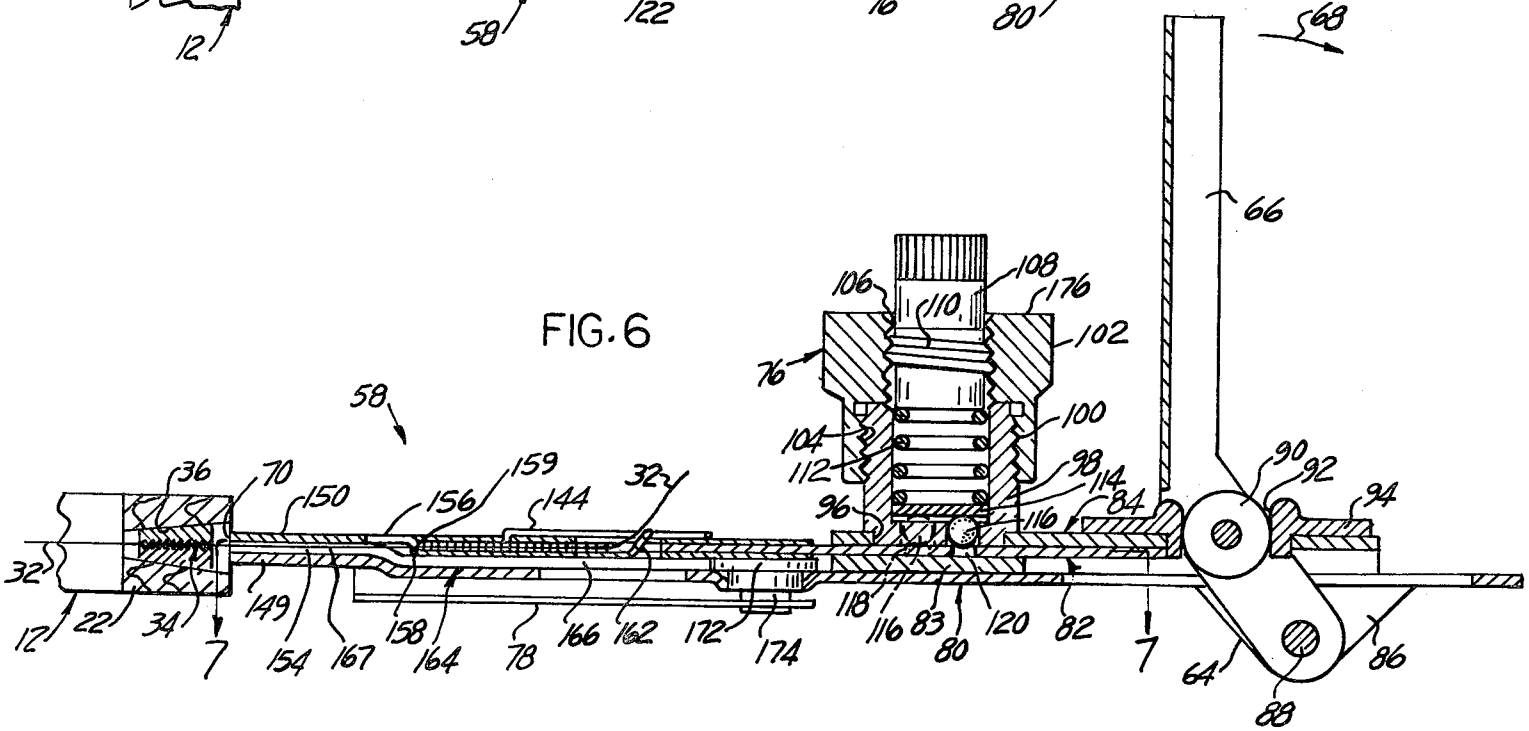
FIG. 6 is a cross-section along line 6—6 of FIG. 5.

A cut-out portion 130, FIG. 7, is formed at the forward end of the enlarged portion 124 of the slide 82. The cut-out portion 130 has slanted lateral edges 132 disposed at a converging angle towards the leading edge 134 of the slide enlarged portion 124. A pair of wedge-shaped jaws 136 are disposed in the cut-out portion 130, each wedge-shaped jaw 136 having a side provided with a bearing member 138 made, for example, of tetrafluoroethylene in sliding engagement with the corresponding slanted edge 132 of the cut-out portion 130. The other side of each wedge-shaped jaw 136 is provided with a plurality of serrations, as shown at 140. The wedge-shaped jaws 136 each are biased towards the leading edge 134 of the enlarged portion 124 of the slide 82 by a compressed coil spring 142 disposed in an appropriate pocket 143, formed at the bottom of the cut-out portion 130, and having an end engaging an appropriate end of each wedge-shaped jaw 136. A loop spring 144, FIGS. 5–7, is attached at each end to one of the wedge-shaped jaws 136 through an aperture 146, such that each wedge-shaped jaw 136 is urged away from the other, with its bearing member 138 urged in constant engagement with the corresponding slanted edge 132 of the cut-out portion 130. As shown at FIG. 5, the loop spring 144 is disposed above the cover plate 128, and its ends are passed through appropriate aperture 148 through the cover plate 128.

The frame 80 is provided at its forward end with a bent up portion 149 supporting a bracket 150 fastened to the frame bent up portion 149 by any convenient means such as, for example, a pair of press-fitted pins 152. The bracket 150 is spaced apart from the frame bent-up portion 149, as shown at 154, FIG. 6, to provide passage therebetween of the end of the length of string 32. The leading edge of the bracket 150 forms the forward tip of the stringing tool 58 engaged with the exterior side of the racket frame 12. A pair of lugs 156 project rearwardly from the bracket 150. Each lug 156 has a bent-down portion 158 disposed through a slot 159 in the cover plate 128, the bent over portions 158 of the lugs 156 forming an abutment engaging the leading edge 160 of the wedge-shaped jaws 136 when the slide 82 is in its forward position, thus retracting the wedge-shaped jaws 136 to the position illustrated at FIG. 7 and simultaneously compressing the coil springs 142. As the loop spring 144 biases the wedge-shaped jaws 136 away from each other with their bearing member 138 constantly in sliding engagement with the slanted edges 132 of the cut-out portion 130, the wedge-shaped jaws 136 are displaced to their open position providing a relatively wide space between the serrated faces 140 of the jaws. The end of the length of string 32 is therefore capable of being pushed through the space between the serrated faces 140 of the wedged jaws 136 until the end of the length of string 32 is deflected upwardly, through the opening 74 in the housing 60, FIG. 4, by an inclined ramp portion 162 formed in the slide 82.

Figure 9:
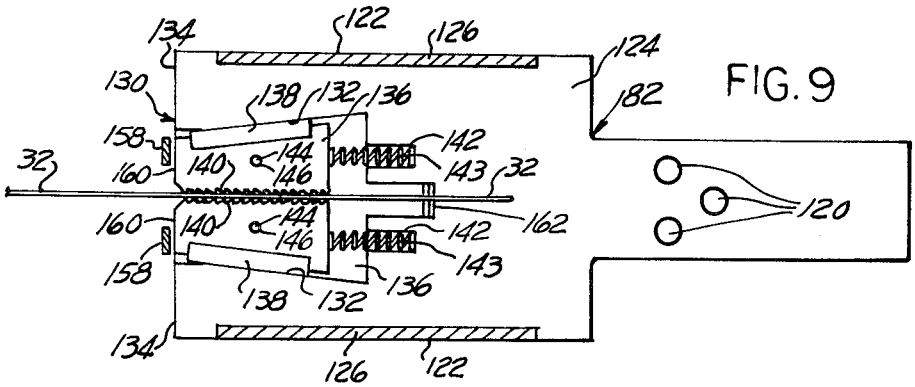
FIG. 9 is a partial view generally from line 9—9 of FIG. 8.
Figure 8:
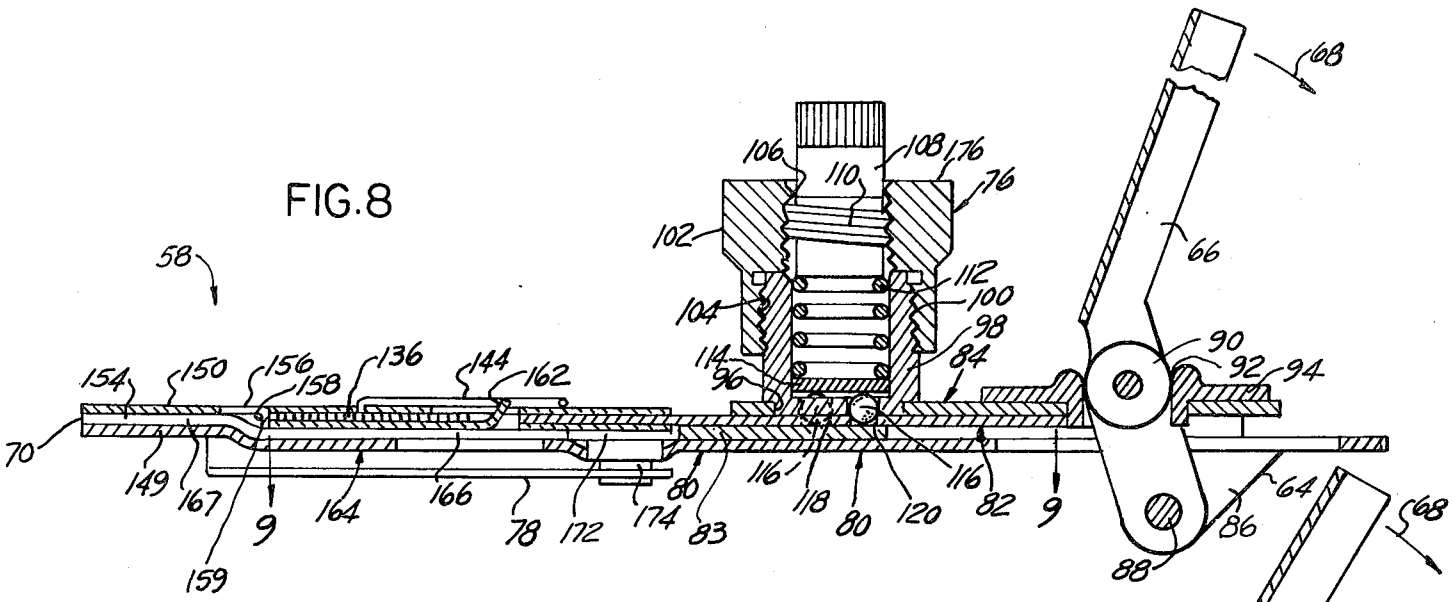
FIG. 8 is a view similar to FIG. 6 but showing the relative position of the diverse elements of the stringing tool of the invention at the beginning of a stringing operation.

When the actuating lever 66 is displaced in the direction of the arrow 68 from the position shown at FIG. 6 to the position shown at FIG. 8, the slide 84 is displaced towards the right, as seen in the drawing, thus in turn displacing the slide 82 to towards the right through the coupling between the two slides resulting from the balls 116 being engaged within the tapered apertures 120 in the slide 82, thus displacing the slide 82 to a position as illustrated at FIG. 9 disengaging the lug abutments 158 from the leading edge 160 of the wedge-shaped jaws 136. The coil springs 142 are consequently enabled to longitudinally displace the wedge-shaped jaws 136 such as to close the jaw serrated faces 140 for gripping the length of string 32 disposed between the jaw serrated faces 140, FIG. 9 as a result of the edge of the jaws provided with the bearing member 138 riding in sliding engagement with the slanted edges 132 of the cut-out portion 130 of the slide enlarged portion 124. Consequently, further pivoting of the actuating lever 66 in the direction of the arrow 68 further displaces both slides 84 and 82 in unison and applies tension upon the length of string 32 as a result of the string 32 being solidly gripped between the jaw serrated faces 140. The string 32 is tensioned with a progressively increasing force until the pull exerted on the end of the string 32 reaches the string tensioning force pre-set by the adjusting knob 76 resulting in a pre-set pressure applied by the coil spring 112 in the cylinder 98 exerted through the intermediary of the disk 114 upon the balls 116.

Figure 10C:
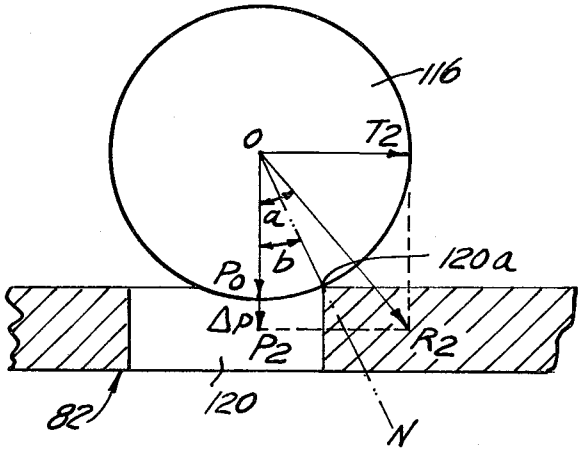
FIGS. 10*a*–10*c* are diagrams of forces useful in explaining the principle of the present invention for applying a pre-set tensioning force upon a racket string.
Figure 10B:
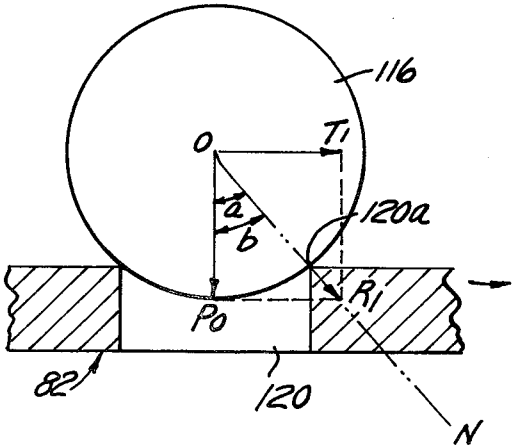
Figure 10A:
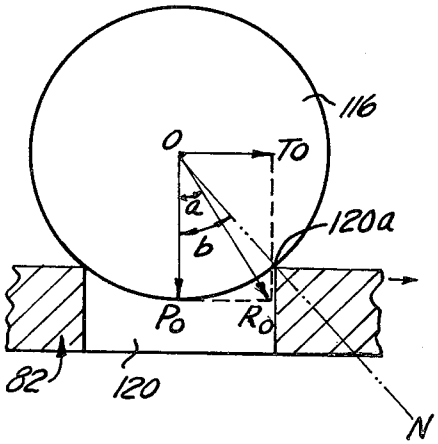
Figure 10:
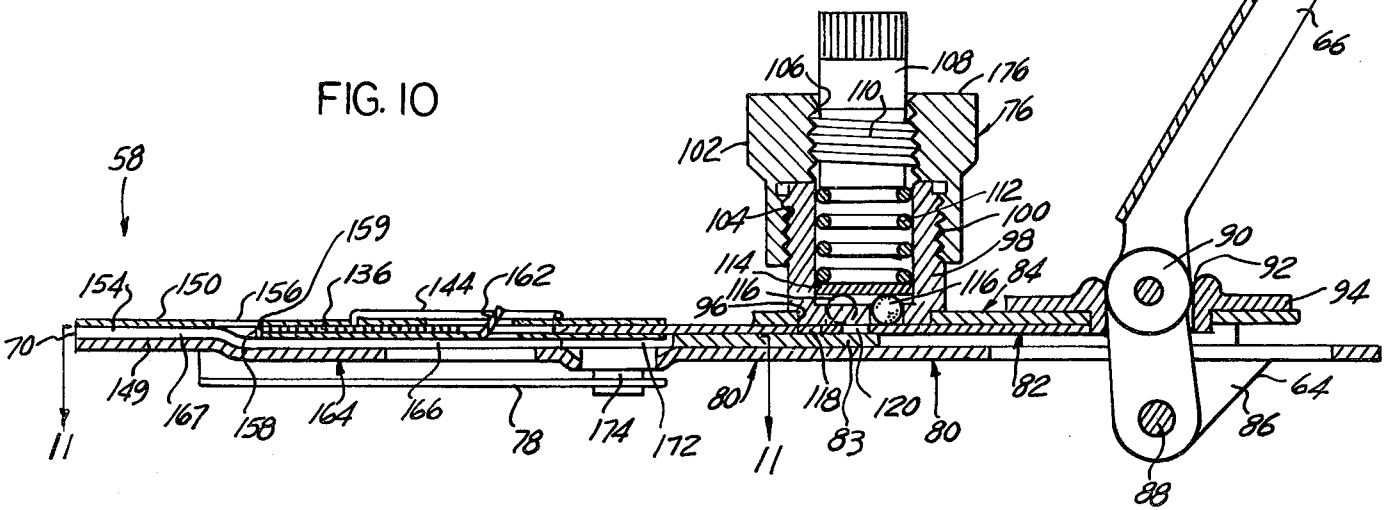
FIG. 10 is a view similar to FIGS. 6 and 8 but showing the relative position of the diverse elements of the stringing tool at the end of a stringing operation.

As shown at FIG. 10*a* representing a diagram of the forces applied upon the center O of a ball 116, with the coil spring 112 adjusted such as to apply a vertically directed force vector $OP_o$ upon the ball 116, the horizontal force applied upon the ball 116 by the operating lever 66, displacing the slide 84, and consequently the cylinder 98, is represented by the horizontal force vector $OT_o$, instantaneously corresponding to the tensioning force applied on the end of the string 32 through the wedge-shaped jaws 136. The phantom line ON represents an imaginary line passing by the center O of the ball 116 and the edge 120*a* of the aperture 120. The resultant force $OR_o$ of the forces $OP_o$ and $OT_o$ applied upon the ball 116 is directed below the edge 120*a* of the aperture 120 and, therefore, urges the ball 116 into the aperture 120 in the slide 82 and simultaneously urges the slide 82 to the right of the drawing. The angle a between the force vector $OP_o$ urging the ball 116 in the aperture 120 and the resultant force $OR_o$ is smaller than the angle b between the line ON and the force vector $OP_o$. As long as the angle a is smaller than the angle b, the slide is displaced to the right of the drawing. When the tensioning force $OT_o$ reaches a value $OT_1$, FIG. 10*b*, equals to the force $OP_o$ of the pressure exerted by the spring 112 upon the ball 116, the resultant force $OR_1$ is aligned with the line ON passing through the edge 120*a* of the aperture 120. Any increase in the value of the tensioning force $OT_1$ tends to cause the ball 116 to climb over the edge 120*a* of the aperture 120, thus causing further compression of the spring 112. When the force of tensioning reaches a value $OT_2$, FIG. 10*c* which is equal to, or slightly greater than the force $OP_2$ applied by the spring 112 upon the ball 116, such force $OP_2$ being equal to $OP_o+P$, wherein P is the increase in pressure applied upon the ball 116 by the further compression of the spring 112 caused by the ball 116 climbing over the edge 120*a* of the aperture 120 in the slide 82, each ball 116 is no longer retained within the aperture 120, with the result that the slide 82, as shown at FIG. 10, is released and is free to retract towards the left under the pull force exerted by the taut length of string 32, if it were not for the anchoring clip 34 being firmly engaged in the tapered stringing hole 36 in the racket frame 12, and being collapsed such that the peripheral portion of the string 32 is gripped by the clip annular teeth 44. The length of string 32 is consequently installed in the racket frame 12 with an appropriate pre-set tension, requiring only that an appropriate calibration of the adjusting knob 76 be accurately effected after assembly of the stringing tool 58.

Figure 11:
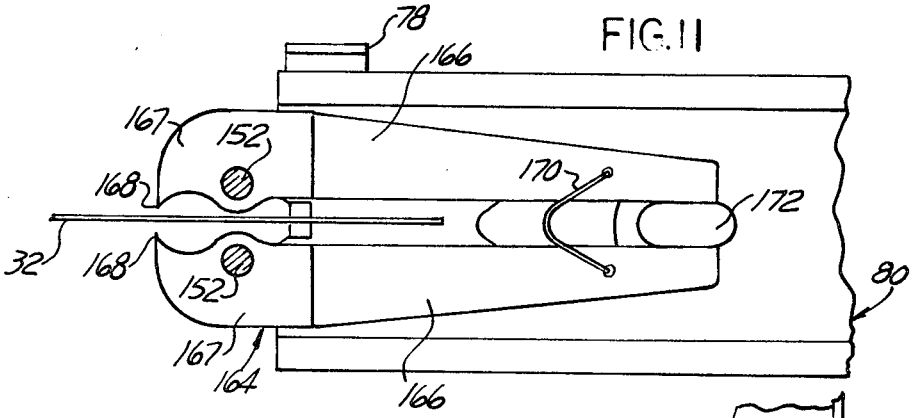
FIG. 11 is a view from line 11—11 of FIG. 10 showing the details of the clipping member of the stringing tool of the invention prior to cutting off a string.
Figure 12:
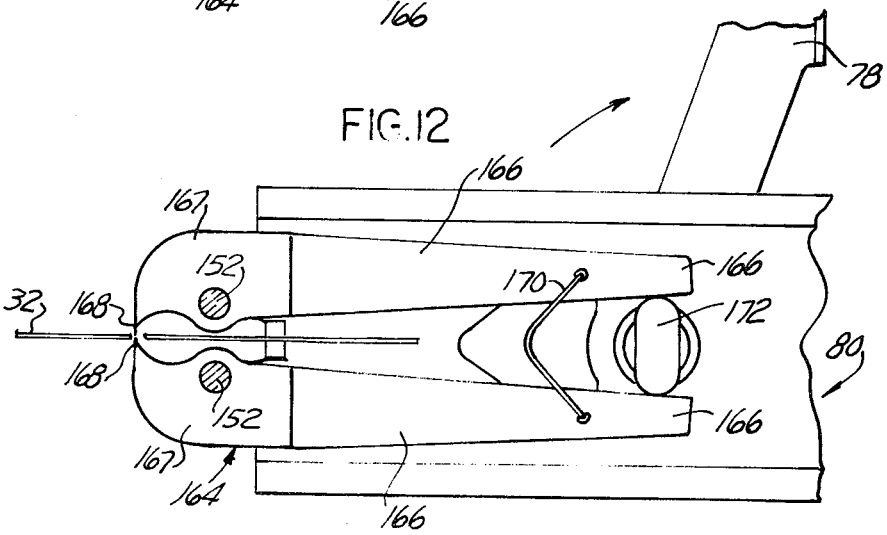
FIG. 12 is a view similar to FIG. 11 but showing the relative position of the clipper member elements after cutting off the string.

The stringing tool 58 is further provided with a string clipper 164 mounted between the support frame 80 and the slide 82, forward of the spacer plate 83. The clipper 164 comprises a pair of cutter arms 166 having each a forward bent-up portion 167 mounted pivotably about one of the pins 152 supporting the bracket 150, and disposed in the space 154 between the bracket 150 and the bent-up forward portion 149 of the frame 80. The bent-up portions of the cutter arms 166 are provided each at its external front portion with a sharp cutting edge 168, FIG. 11. The other ends of the cutter arms 166 are urged towards each other by a spring 170, a rotatable camming member 172 being disposed between the cutter arm ends. The camming member 172 is rotatably mounted on the frame 80, the lever 78 being attached to a portion 174 of the camming member 172 projecting below the frame 80. During tensioning of the length of string 32, the lever 78 is in the position illustrated at FIG. 11 with the result that the cutting edges 168 are apart as a result of the camming member 172 being disposed between the ends of the cutter arms 166 in its width position. By swinging the lever 78 to the position of FIG. 12, the ends of the cutter arms 166 are spread apart by the camming member 172 rotating from the position illustrated at FIG. 11 to the position illustrated at FIG. 12, thus causing the cutting edges 168 to cut off the end of the string 32 substantially flush with the edge of the stringing hole 36 in the racket frame 12.

The tensionsing force, or, in other words, the pull exerted on the string 32 by the stringing tool 58 of the invention is adjusted, as previously mentioned, by the adjusting knob 76 by way of providing on the peripheral surface of the plug 108 a reference scribe line and by appropriate markings enscribed on the top annular face 176 of the sleeve 102 in pounds, as shown at 178 at FIG. 4. By rotating the plug 108, with the sleeve 102 fastened tight over the cylinder 98, to an appropriate angular position placing the reference line on the peripheral surface of the plug 108 in registry with the desired tensioning force to be exerted on the racket string, the coil spring 112 in the cylinder 98 is compressed such as to exert upon the balls 116 an appropriate pressure that will maintain the coupling between the slide 84 and the slide 82 until the coupling becomes disengaged when the desired tensioning force is exerted on the string32, as hereinbefore explained in details.

Having thus described the present invention by way of an example of structure thereof well suited to accomplish the objects of the present invention, modification whereof will be apparent to those skilled in the art,

What is claimed as new is as follows:

1. A stringing tool for a racket having a frame surrounding an open area and a plurality of individual strings defining a net-like interlacing covering the open area of said frame, said frame having apertures through which an end of one of said strings is held by means of an anchoring clip, said stringing tool comprising means for gripping one of said strings at an end projecting from said frame, means for displacing said gripping means in a direcion placing said string under tension, and means for releasing said string upon applying thereon a pull at least equal to a pre-set pulling force, wherein said means for gripping said string comprises a first slide disposed in a frame, a pair of symmetrically disposed jaws having each a serrated face for engagement with said string, and means for displacing said serrated faces away from each other for introducing said string therebetween and for displacing said serrated faces towards each other for clamping said string therebetween, wherein said means for displacing said serrated jaw faces comprises a cut-out portion in said slide having a pair of lateral edges disposed at an angle relative to each other, said jaws having each a lateral edge in sliding engagement with one of said cut-out portion lateral edges, first biasing means urging said jaw lateral edges in sliding engagement with said cut-out portion lateral edges, second biasing means longitudinally displacing said jaws in a direction urging said jaw serrated faces towards each other, and stationary abutment means engageable with said jaws for longitudinally displacing said jaws in an opposite direction causing said serrated faces to move away from each other.

2. The stringing tool of claim 1 further comprising means for cutting off the portion of said string projecting beyond said frame.

3. The stringing tool of claim 2 wherein said string cut-off means comprises a pair of displaceable opposed cutting edges and means for displacing said cutting edges towards each other with said projecting portion of said string disposed between said cutting edges.

4. The stringing tool of claim 3 further comprising a pair of pivotable arms each having two ends wherein said cutting edges are formed each on one end of one of said pivotable arms, a rotatable camming member being disposed between the other ends of said pivotable arms, and wherein a lever is attached to said rotatable camming member for rotating said camming member from a position whereby said cutting edges are spread apart to a position causing pivoting of said pivoting arms for displacing said cutting edges toward each other.

5. The stringing tool of claim 1 wherein said means for displacing said gripping means comprises a second slide, an actuating lever adapted to reciprocate said second slide, and coupling means between said first and second slides releasable upon reaching a predetermined force opposing displacement of said first slide in a direction exerting a pull on said string for releasing said string upon applying thereon a pull at least equal to said pre-set pulling force.

6. The stringing tool of claim 5 wherein said releasable coupling means comprises at least one ball disposed in an aperture in said first slide, biasing means urging said ball through said aperture towards said first slide, and an aperture of a diameter less than the diameter of said ball in said second slide for engagement by a projecting portion of said ball.

7. The stringing tool of claim 6 wherein there is at least three of said balls and said biasing means is a compressed coil spring disposed in the bore of a cylinder and a disk urged by said compressed coil spring in engagement with a portion of said balls projecting within said cylinder, and means for varying the amount of compression of said coil spring.

8. The stringing tool of claim 7 wherein said means for varying the amount of compression of said coil spring comprises a plug threading in the end of said cylinder.

9. A stringing tool for a racket having a frame surrounding an open area and a plurality of individual strings defining a net-like interlacing covering the open area of said frame, said frame having apertures through which an end of one of said strings is held by means of an anchoring clip, said stringing tool comprising means for gripping one of said strings at an end projecting from said frame, means for displacing said gripping means in a direction placing said string under tension, and means for releasing said string upon applying thereon a pull at least equal to a pre-set pulling force, wherein said means for gripping said string comprises a first slide disposed in a frame, a pair of symmetrically disposed jaws having each a serrated face for engagement with said string, and means for displacing said serrated faces away from each other for introducing said string therebetween and for displacing said serrated faces towards each other for clamping said string therebetween, wherein said means for displacing said gripping means comprises a second slide, an actuating lever adapted to reciprocate said second slide, and coupling means between said first and second slides releasable upon reaching a predetermined force opposing displacement of said first slide in a direction exerting a pull on said string for releasing said string upon applying thereon a pull at least equal to said pre-set pulling force.

10. The stringing tool of claim 9 wherein said means for displacing said serrated jaw faces comprises a cut-out portion in said slide having a pair of lateral edges disposed at an angle relative to each other, said jaws having each a lateral edge in sliding engagement with one of said cut-out portion lateral edges, first biasing means urging said jaw lateral edges in sliding engagement with said cut-out portion lateral edges, second biasing means longitudinally displacing said jaws in a direction urging said jaw serrated faces towards each other, and stationary abutment means engageable with said jaws for longitudinally displacing said jaws in an opposite direction causing said serrated faces to move away from each other.

11. The stringing tool of claim 9 wherein said releasable coupling means comprises at least one ball disposed in an aperture in said first slide, biasing means urging said ball through said aperture towards said first slide, and an aperture of a diameter less than the diameter of said ball in said second slide for engagement by a projecting portion of said ball.

12. The stringing tool of claim 11 wherein there is at least three of said balls and said biasing means is a compressed coil spring disposed in the bore of a cylinder and a disk urged by said compressed coil spring in engagement with a portion of said balls projecting within said cylinder, and means for varying the amount of compression of said coil spring.

13. The stringing tool of claim 12 wherein said means for varying the amount of compression of said coil spring comprises a plug threading in the end of said cylinder.

14. The stringing tool of claim 7 further comprising means for cutting off the portion of said string projecting beyond said frame.

15. The stringing tool of claim 14 wherein said string cut-off means comprises a pair of displaceable opposed cutting edges and means for displacing said cutting edges towards each other with said projecting portion of said string disposed between said cutting edges.

16. The stringing tool of claim 15 wherein said cutting edges are formed each on the end of a pivotable arm, a rotatable camming member is disposed between the other end of said pivotable arm, and a lever is attached to said rotatable camming member for rotating said camming member from a position whereby said cutting edges are spread apart to a position causing pivoting of said pivoting arms for displacing said cutting edges toward each other.

17. A stringing tool for a racket having a frame surrounding an open area and a plurality of individual strings defining a net-like interlacing covering the open area of said frame, said frame having apertures through which an end of one of said strings is held by means of an anchoring clip, said stringing tool comprising means for gripping one of said strings at an end projecting from said frame, means for displacing said gripping means in a direction placing said string under tension, means for releasing said string upon applying thereon a pull at least equal to a pre-set pulling force, and means for cutting off the portion of said string projecting beyond said frame, wherein said string cut-off means comprises a pair of displaceable opposed cutting edges and means for displacing said cutting edges towards each other with said projecting portion of said string disposed between said cutting edges; said tool further comprising a pair of pivotable arms each having two ends, wherein said cutting edges are formed each on one end of one of said pivotable arms, a rotatable camming member being disposed between the other ends of said pivotable arms, and wherein a lever is attached to said rotatable camming member for rotating said camming member from a position whereby said cutting edges are spread apart to a position causing pivoting of said pivoting arms for displacing said cutting edges toward each other.

18. The stringing tool of claim 17 wherein said means for gripping said string comprises a first slide disposed in a frame, a pair of symmetrically disposed jaws having each a serrated face for engagement with said string, and means for displacing said serrated faces away from each other for introducing said string therebetween and for displacing said serrated faces towards each other for clamping said string therebetween.

19. The stringing tool of claim 18 wherein said means for displacing said serrated jaw faces comprises a cut-out portion in said slide having a pair of lateral edges disposed at an angle relative to each other, said jaws having each a lateral edge in sliding engagement with said cut-out portion lateral edge, first biasing means urging said jaw lateral edges in sliding engagement with one of said cut-out portion lateral edges, second biasing means longitudinally displacing said jaws in a direction urging said jaw serrated faces towards each other, and stationary abutment means engageable with said jaws for longitudinally displacing said jaws in an opposite direction causing said serrated faces to move away from each other.

20. The stringing tool of claim 19 wherein said means for displacing said gripping means comprises a second slide, an actuating lever adaped to reciprocate said second slide, and coupling means between said first and second slides releasable upon reaching a predetermined force opposing displacement of said first slide in a direction exerting a pull on said string for releasing said string upon applying thereon a pull at least equal to said pre-set pulling force.

21. The stringing tool of claim 20 wherein said releasable coupling means comprises at least one ball disposed in an aperture in said first slide, biasing means urging said ball through said aperture towards said first slide, and an aperture of a diameter less than the diameter of said ball in said second slide for engagement by a projecting portion of said ball.

22. The stringing tool of claim 21 wherein there is at least three of said balls and said biasing means is a compressed coil spring disposed in the bore of a cylinder and a disk urged by said compressed coil spring in engagement with a portion of said balls projecting within said cylinder, and means for varying the amount of compression of said coil spring.

23. The stringing tool of claim 22 wherein said means for varying the amount of compression of said coil spring comprises a plug threading in the end of said cylinder.

24. The stringing tool of claim 3 wherein said means for displacing said gripping means comprises a second slide, an actuating lever adapted to reciprocate said second slide, and coupling means between said first and second slides releasable upon reaching a predetermined force opposing displacement of said first slide in a direction exerting a pull on said string for releasing said string upon applying thereon a pull at least equal to said pre-set pulling force.

25. The stringing tool of claim 24 wherein said releasable coupling means comprises at least one ball disposed in an aperture in said first slide, biasing means urging said ball through said aperture towards said first slide, and an aperture of a diameter less than the diameter of said ball in said second slide for engagement by a projecting portion of said ball.

26. The stringing tool of claim 25 wherein there is at least three of said balls and said biasing means is a compressed coil spring disposed in the bore of a cylinder and a disk urged by said compressed coil spring in engagement with a portion of said balls projecting within said cylinder, and means for varying the amount of compression of said coil spring.

27. The stringing tool of claim 26 wherein said means for varying the amount of compression of said coil spring comprises a plug threading in the end of said cylinder.

* * * * *